US009318831B2

(12) United States Patent
Yamada et al.

(10) Patent No.: US 9,318,831 B2
(45) Date of Patent: Apr. 19, 2016

(54) CONNECTOR

(71) Applicant: Molex, LLC, Lisle, IL (US)

(72) Inventors: Eiichi Yamada, Yamato (JP); Koji Chikano, Setagaya (JP); Ryo Sumiya, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/291,171

(22) Filed: May 30, 2014

(65) Prior Publication Data

US 2015/0024640 A1 Jan. 22, 2015

(30) Foreign Application Priority Data

May 31, 2013 (JP) ..... 2013-114821

(51) Int. Cl.

| | |
|---|---|
| ***H01R 13/24*** | (2006.01) |
| *H01R 4/26* | (2006.01) |
| *H01R 4/48* | (2006.01) |
| *H01R 11/01* | (2006.01) |
| *H01R 11/03* | (2006.01) |
| *H01R 13/11* | (2006.01) |
| *H01R 12/77* | (2011.01) |
| *H01R 31/02* | (2006.01) |
| *H01R 4/28* | (2006.01) |
| *H01R 12/71* | (2011.01) |
| *H01R 12/70* | (2011.01) |
| *H01R 9/22* | (2006.01) |
| *H01R 12/58* | (2011.01) |
| *H01R 12/51* | (2011.01) |
| *H01R 13/187* | (2006.01) |

(52) U.S. Cl.

CPC ..... *H01R 13/2442* (2013.01); *H01R 4/26* (2013.01); *H01R 4/28* (2013.01); *H01R 4/48* (2013.01); *H01R 4/4818* (2013.01); *H01R 4/4845* (2013.01); *H01R 9/22* (2013.01); *H01R 11/01* (2013.01); *H01R 11/03* (2013.01); *H01R 12/515* (2013.01); *H01R 12/58* (2013.01); *H01R 12/7064* (2013.01); *H01R 12/716* (2013.01); *H01R 12/778* (2013.01); *H01R 13/111* (2013.01); *H01R 13/113* (2013.01); *H01R 13/114* (2013.01); *H01R 13/187* (2013.01); *H01R 31/02* (2013.01)

(58) Field of Classification Search

CPC .... H01R 4/4818; H01R 13/111; H01R 31/02; H01R 12/515; H01R 4/26; H01R 12/58; H01R 4/28; H01R 4/48; H01R 11/01; H01R 13/187; H01R 9/22

USPC ..... 439/862, 441, 439, 835

See application file for complete search history.

(56) References Cited

U.S. PATENT DOCUMENTS 6,093,052 A * 7/2000 Wang ..... H01R 4/4818 439/439

6,398,598 B2 * 6/2002 Masumoto ..... H01R 13/2442 439/862

*Primary Examiner* — Abdullah Riyami

*Assistant Examiner* — Justin Kratt

(74) *Attorney, Agent, or Firm* — James A. O'Malley

(57) ABSTRACT

A connector having a housing and a terminal made installed therein is disclosed. The terminal has a base portion held by the housing, a first contact member connected on one end to the base portion in the longitudinal direction, and a pair of second contact members connected to the ends of the base portion in the longitudinal direction. The first contact member includes a first contact portion in the vertical direction. Each second contact member includes a second contact portion in the vertical direction. The pair of second contact members is arranged linearly in the longitudinal direction of the base portion. The first and second contact members are arranged in the transverse direction of the base portion. The first contact portion and the second contact portion are positioned on the base portion.

21 Claims, 11 Drawing Sheets

CONNECTOR

REFERENCE TO RELATED APPLICATIONS

The Present Disclosure claims priority to prior-filed Japanese Patent Application No. 2013-114821, entitled "Connector," filed on 31 May 2013 with the Japanese Patent Office. The content of the aforementioned Patent Application is incorporated in its entirety herein.

BACKGROUND OF THE PRESENT DISCLOSURE

The Present Disclosure relates, generally, to a connector, and, more particularly, to a connector in which the first contact member and a pair of second contact members of a terminal are arranged side by side in the transverse direction of a base portion, thereby enabling the first contact member and the pair of second contact members to connect electrically to an opposing first contact member and an opposing pair of second contact members, while also being easy to manufacture, and having a simple configuration and a low profile.

Conventional connectors, with elastically deformable terminals, can be used to supply current and signals to electrodes disposed on a flat board or panel. An example is disclosed in Japanese Patent No. 3477640, the content of which is incorporated in its entirety herein.

FIG. 11 illustrates the connection of a conventional connector to a board, in which FIG. 11(*a*) illustrates the terminals in various positions of elastic deformation and FIG. 11(*b*) illustrates the terminals fully elastically deformed. In FIGS. 11(*a*) and 11(*b*), 891 is a mounting board such as a printed circuit board, and 811 is the housing of a connector mounted on the mounting board 891. In the housing 811, a plurality of recessed portions 814 are formed side-by-side, and a terminal 851 is loaded into each of the recessed portions 814. Each terminal 851 includes a tail portion 856 protruding outward from the housing 811, and each tail portion 856 is electrically or mechanically connected to a contact pad (not shown) on the top surface of the mounting board 891 using solder. The contact pads are connected to circuits (not shown) on the mounting board 891.

Also, 901 is an opposing board having a plurality of contact pads formed on the bottom surface (not shown). When the opposing board 901 is brought close to the mounting board 891, so that the boards are parallel to each other, the contact pads on the opposing board 901 are pressed against the contact portions 854 of the terminals 851 protruding from the top surface of the housing 811 by height I. This elastically deforms the terminals 851 from the position shown in FIG. 11(*a*) to the position shown in FIG. 11(*b*). The contact pads are then connected to circuits (not shown) on the opposing board 901. An electrical connection is thus established between circuits on the mounting board 891 and circuits on the opposing board 901 via the terminals 851. Accordingly, the mounting board 891 and opposing board 901 are held in the positional relationship shown in FIG. 11(*b*), and connected to each other mechanically using connecting members (not shown) such as bolts or hooks.

However, in conventional connectors, the tail portions 856 of the terminals 851 are connected to contact pads on the mounting board 891. As a result, the circuits on the opposing board 901 cannot be connected to the mounting board 891 using a separate electric cable. Further, it is generally not appropriate to supply a large current to the circuits of a mounting board 891 such as a printed circuit board, but it is usually desirable to supply power from a power source such as a battery via a cable including electric wires with a round cross-sectional profile when the opposing board 901 includes electric components that consume a relatively large amount of power. However, electric wires with a round cross-sectional profile cannot be connected to the terminals 851 in conventional connectors. Also, when a plurality of opposing boards 901 are connected using electrical wires to form a daisy chain and a parallel circuit with respect to the power source in order to operate the opposing boards 901 simultaneously, two wires have to be connected to each terminal 851. This, again, cannot be realized using a conventional connector.

SUMMARY OF THE PRESENT DISCLOSURE

It is an object of the Present Disclosure to provide a reliable connector in which the first contact member and a pair of second contact members of a terminal are arranged side by side in the transverse direction of a base portion thereby enabling the first contact member and the pair of second contact members to connect electrically to an opposing first contact member and an opposing pair of second contact members while also being easy to manufacture, and having a simple configuration and a low profile.

In one embodiment, the Present Disclosure comprises a connector having a housing made from an insulating material, and a terminal made from a conductive material and installed in the housing. The terminal has a flat base portion held by the housing, an elastically-deformable first contact member connected on one end to the base portion in the longitudinal direction, and a pair of elastically-deformable second contact members connected to the ends of the base portion in the longitudinal direction. The first contact member includes an elastically-displaceable first contact portion in the vertical direction. Each second contact member includes an elastically-displaceable second contact portion in the vertical direction, and as viewed from above. The pair of second contact members is arranged linearly in the longitudinal direction of the base portion. The first and second contact members are arranged in the transverse direction of the base portion. The first contact portion and the second contact portion are positioned on the base portion.

In another embodiment, the first contact member includes a first curved portion connected to the base portion and a first straight arm portion connected to the base end thereof. The first contact portion is connected to the leading end of the first straight arm portion. Each second contact member includes a second curved portion connected to the base portion and a second straight arm portion connected to the base end thereof. The second contact portion is connected to the leading end of the second straight arm portion.

In another embodiment, the base portion includes an integrally-formed fin member. The fin member is a flat member extending in a direction orthogonal to the surface of the base portion, and in a direction crossing the transverse direction of the base portion.

In another embodiment, the housing includes a plurality of recessed portions for accommodating a terminal arranged side-by-side in the transverse direction of the housing. Each recessed portion includes a first accommodating portion for accommodating a first contact member, a second accommodating portion for accommodating second contact members, and a communicating portion allowing the first accommodating portion and the second accommodating portion to communicate. The first accommodating portion and the second accommodating portion are arranged side-by-side in the transverse direction of the housing.

In another embodiment, the housing includes a first opening passing through the housing from the top surface to the first accommodating portion, and a second opening passing through the housing from the front surface and rear surface to the second accommodating portion. The first contact portion is exposed by the first opening and brought into contact with an opposing first contact member positioned above the top surface. The second contact portion is brought into contact with an opposing second contact member inserted into the second opening.

Another embodiment includes a terminal supporting member installed in the housing, which includes a flat base portion held in the housing and a protruding piece formed in the base portion. The protruding piece is arranged inside the second accommodating portion so the protruding piece opposes the second contact portion. Finally, in still another embodiment, the housing is formed so that the front half portion near the front surface and the rear half portion near the rear surface are joined, and the joined portions are positioned away from the center line of the housing in the longitudinal direction.

In the Present Disclosure, a first contact member and a pair of second contact members of a terminal are arranged side by side in the transverse direction of a base portion, thereby enabling the contact members to connect electrically to an opposing first contact member and an opposing pair of second contact members, respectively, while also providing a reliable connector that is easy to manufacture, and has a simple configuration and a low profile.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
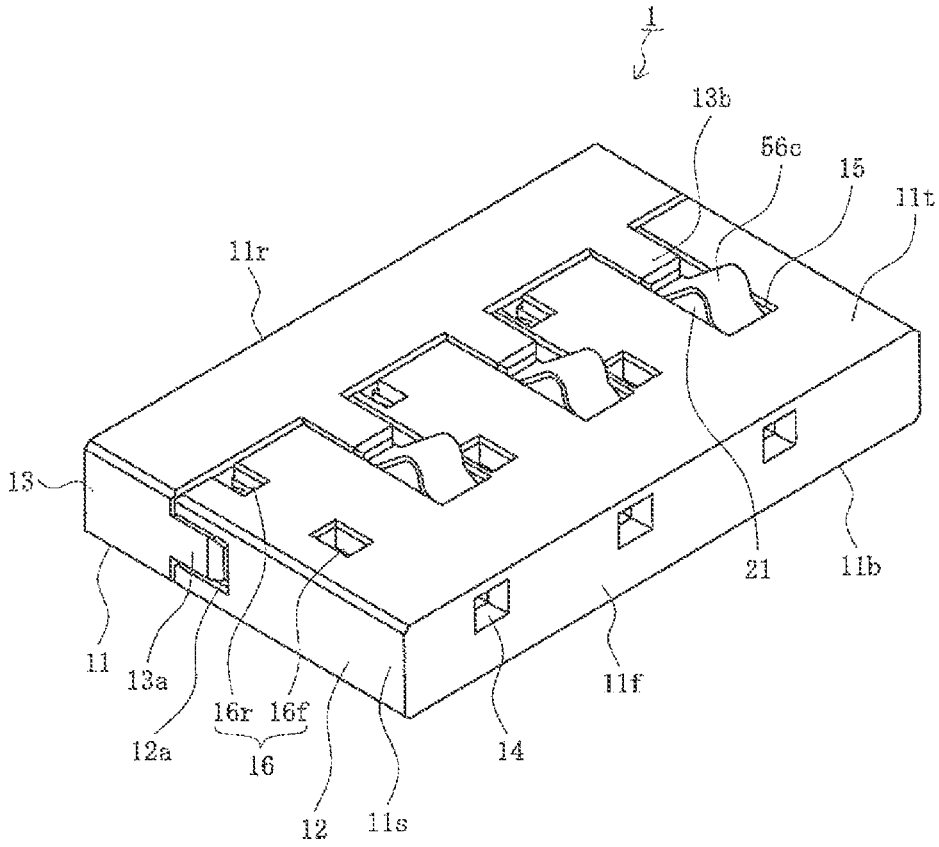
FIG. 1 is a perspective view of a connector in an embodiment of the Present Disclosure.
Figure 2A:
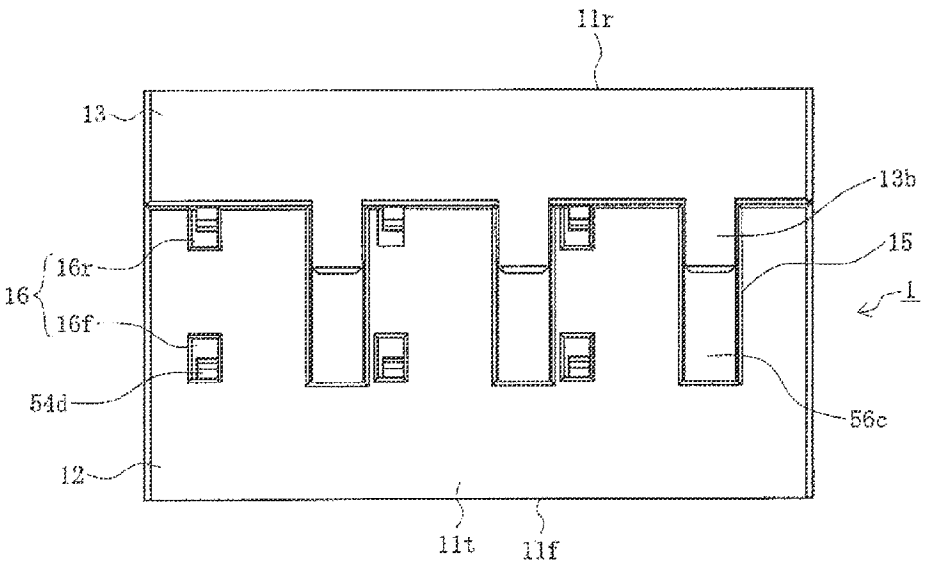
FIGS. 2(*a*)-(*c*) are a set of three views of the connector of FIG. 1, in which FIG. 2(*a*) is a top view, FIG. 2(*b*) is a front view and FIG. 2(*c*) is a side view.
Figure 2B:
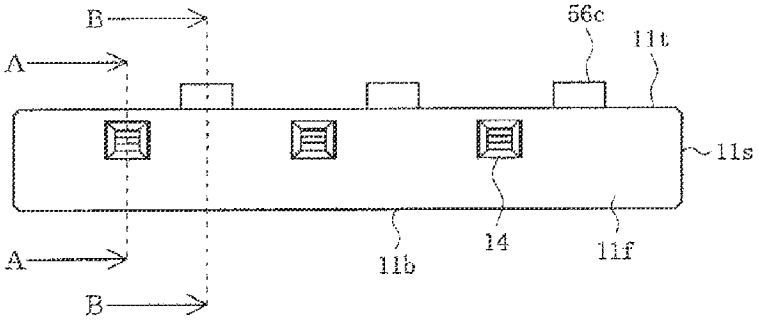
Figure 2C:
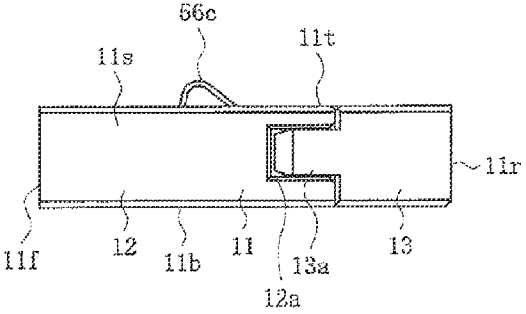

Referring to FIGS. 1-2, a connector 1 is mounted on the top surface 91*t* of a base 91, described below. The base 91 may be a plate member analogous to an outer wall, inner wall or ceiling of a building, and may be any type of member attachable to the housing 11 using any means of attachment, such as an adhesive, bolt or fitting, while allowing the bottom surface 11*b* of the housing 11 of the connector 1 to come into contact with the top surface 91*t*.

The opposing device 101, described below, is mounted on the top surface 91*t* side of the base 91, and the opposing device 101 is connected to the connector 1 to establish an electrical connection with electric wire 95, serving as the opposing second contact member, described below, and which is connected beforehand to the connector 1. The opposing device 101 can be any flat electric device or electronic device, such as a liquid crystal display, light-emitting diode (LED) display or an LED lighting device. The device includes a contact pad 161 serving as the opposing first contact member, described below, which is able to make contact with the first contact portion 56*c* protruding upward from the top surface 11*t* of the housing 11. This may be any type of device attachable to the housing 11 or base 91 using any means of attachment such as an adhesive, bolt or fitting.

As shown in the Figures, the connector 1 has a housing 11 molded from an insulating material, such as a synthetic resin, and terminals 51 described below which are punched out of a sheet of a conductive material, such as a metal, and bent, and are fitted into the housing 11. The terminals 51 are accommodated inside accommodating recessed portions 21 in the housing 11, and the first contact portion 56*c* protrudes from a first opening 15 serving as a terminal exposing opening which is formed in the top surface 11*t* of the housing 11. Also, the housing 11 is a flat rectangular body having a top surface 11*t*, a bottom surface 11*b*, a front surface 11*f*, a rear surface 11*r* and left and right side surfaces 11*s*. It also has a low profile in which the height dimension (the vertical direction in FIG. 2(*b*)) is small (for example, approximately 4 mm). The housing 11 is formed by joining a front half portion 12 or first portion integrally molded from an insulating material, such as a synthetic resin, to a rear half portion 13 or second portion integrally molded from the same insulating material, such as a synthetic resin. When the front half portion 12 and the rear half portion 13 are joined, the front engaging portions 12*a* and the rear engaging portions 13*a* engage each other on the side surfaces 11*s* of the housing 11.

The housing 11 has a plurality of accommodating recessed portions 21 arranged side by side but separate from each other in the transverse direction (the left-right direction in FIG. 2(*a*)), and a terminal 51 is accommodated in each one of the accommodating recessed portions 21. The number of accommodating recessed portions 21 can be established at will, but a terminal 51 must be accommodated inside all of the accommodating recessed portions 21.

The front surface 11*f* and the rear surface 11*r* each have a second opening 14, serving as an electric wire insertion hole for each one of the accommodating recessed portions 21 (three in the example shown in the Figure). Each second opening 14 is a through-hole formed to pass from the front surface 11*f* or rear surface 11*r* into an accommodating recessed portion 21. The leading end of each electric wire 95 is inserted into a second opening 14 from outside of the housing 11 until it reaches into an accommodating recessed portion 21 and comes into contact with a terminal 51.

A first opening 15 is formed in the top surface 11*t* of each accommodating recessed portion 21. Each first opening 15 is a through-hole formed to pass from the top surface 11*t* into an accommodating recessed portion 21*t*. The first contact portion 56*c* of each terminal 51 passes through a first opening 15 and protrudes upward from the top surface 11*t*. The portion of each first opening 15 near the rear surface 11*r* is stopped by a stopping member 13*b* protruding from the front end of the rear half portion 13. The stopping member 13*b* stops the first contact portion 56*c* from being displaced upward. This limits the amount by which the first contact portion 56*c* can protrude upward towards the top surface 11*t*.

A third front opening 16*f* and a third rear opening 16*r* is formed for each accommodating recessed portion 21 in the top surface 11*t*. Each third front opening 16*f* and third rear opening 16*r* is a through-hole formed to pass from the top surface 11*t* into an accommodating recessed portion 21. As shown in FIG. 2(*a*), the operating portion 54*d* of each terminal 51 is positioned directly beneath the third front opening 16*f* and third rear opening 16*r* of each accommodating recessed portion 21, and the leading end of a needle-shaped or rod-shaped member (not shown) can be inserted into the third front opening 16*f* or the third rear opening 16*r* from outside of the housing 11 to displace the operating portion 54*d* downward. When the third front opening 16*f* and the third rear opening 16*r* are being explained collectively, they will be referred to simply as the third openings 16.

Figure 3:
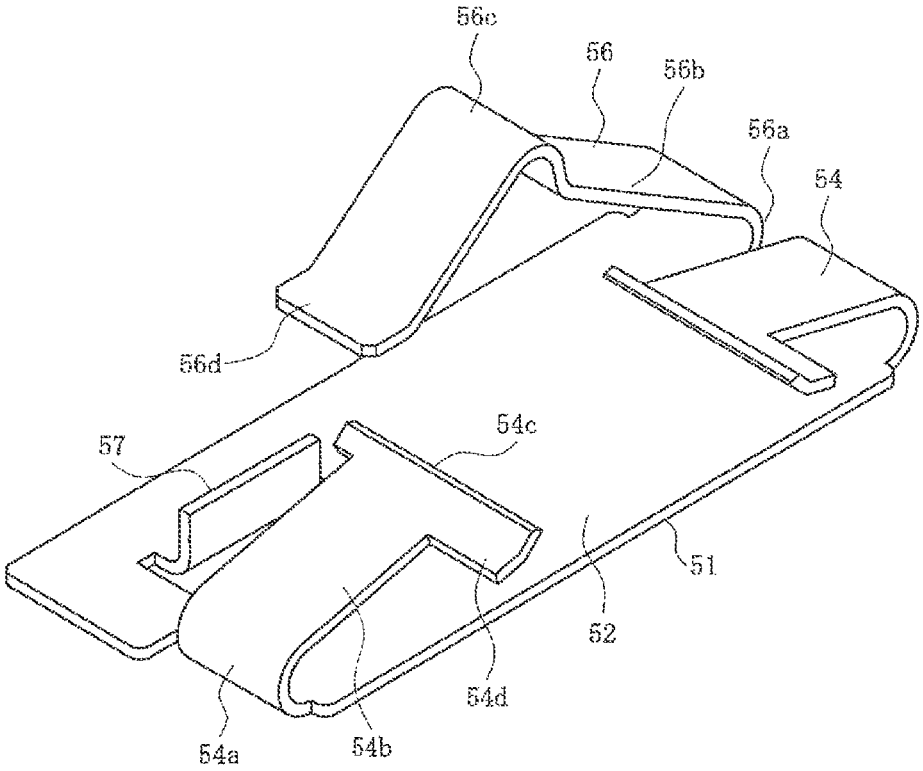
FIG. 3 is a perspective view of a terminal in an embodiment of the Present Disclosure.
Figure 4A:
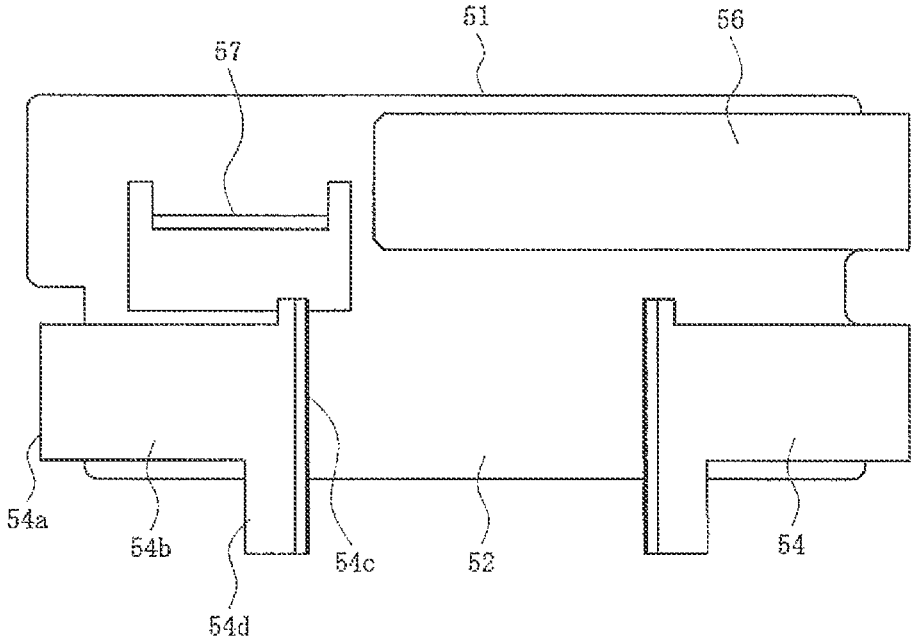
FIGS. 4(*a*)-(*b*) are a pair of views of the terminal of FIG. 3, in which FIG. 4(*a*) is a top view and FIG. 4(*b*) is a side view.
Figure 4B:
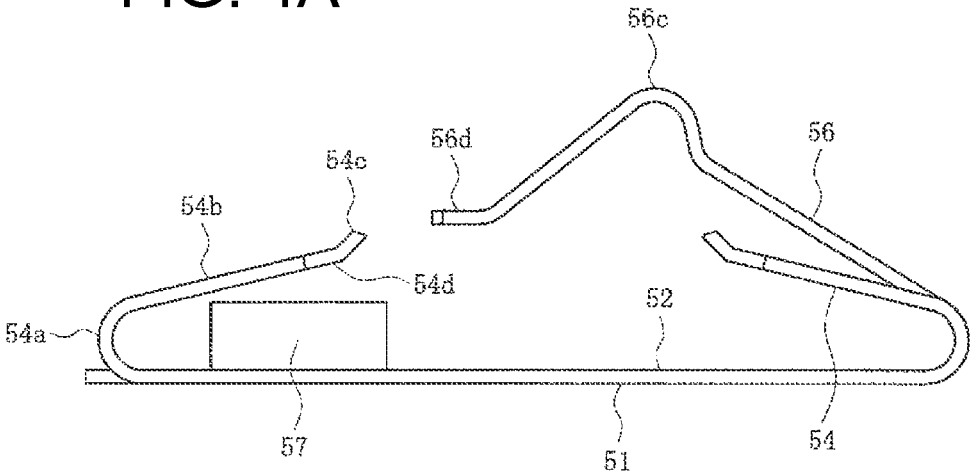

Referring to FIGS. 3-4, the terminals 51 are integrally formed by punching out and bending a slender conductive metal plate into the desired shape. Each terminal 51 has a flat, rectangular base portion 52 held by the housing 11, an elastically-deformable first contact member 56 connected on one end (the right end in FIG. 4) to the base portion 52 in the longitudinal direction, a fin member 57 formed near the other end (the left end in FIG. 4) of the base portion 52 in the longitudinal direction, and a pair of elastically-deformable second contact members 54 connected to both ends of the base portion 52 in the longitudinal direction. The first contact member 56 and the second contact members 54 are arranged side-by-side in the short axis direction of the base portion 52; that is, in the transverse direction (the vertical direction in FIG. 4(*a*)). In other words, they are arranged in parallel. Also, each of the second contact members 54 are arranged linearly and opposed to each other in the longitudinal direction of the base portion 52, as viewed from above.

The first contact member 56 is integrally formed by bending a slender plate, and includes a first curved portion 56*a* whose base end is connected to one end of the base portion 52 in the longitudinal direction and is bent 90° or more so that the leading end is directed above the other end of the base portion 52 in the longitudinal direction, a flat first straight arm portion 56*b* whose base end is connected to the leading end of the front curved portion 56*a* and whose leading end extends above the other end of the base portion 52 in the longitudinal direction, a first contact portion 56*c* whose base end is connected to the leading end of the first straight arm portion 56*b*, whose top portion curves to be positioned above the leading end of the first straight arm portion 56*b* and whose leading end extends below the other end of the base portion 52 in the longitudinal direction, and a stopped portion 56*d* extending parallel to the base portion 52 from the leading end of the first contact portion 56*c* to the other end of the base portion 52 in the longitudinal direction. As mentioned above, the first contact portion 56*c* makes contact with a contact pad 161 in the opposing device 101, and is elastically displaced vertically by the elastic deformation of the first curved portion 56*a* and the first straight arm portion 56*b*. The first contact portion 56*c* is positioned above the base portion 52 when viewed from above.

Each second contact member 54 is integrally formed by bending a slender plate. Each second contact member 54 includes a second curved portion 54*a* whose base end is connected to the one end or the other end of the base portion 52 in the longitudinal direction and whose leading end is bent 90° or more to be directed above the base portion 52 along the center line in the longitudinal direction, a flat second straight arm portion 54*b* whose base end is connected to the leading end of the second curved portion 54*a* and whose leading end extends to be directed above the base portion 52 along the center line in the longitudinal direction, a second contact portion 54*c* which is bent and connected to the leading end of the second straight arm portion 54*b* and whose leading end extends upward at an angle to be directed above the leading end of the second straight arm portion 54*b*, and an operating portion 54*d* extending from the leading end of the second straight arm portion 54*b* towards the outside of the base portion 52 in the transverse direction. The second contact portion 54*c* makes contact with the leading end of an electric wire 95 inserted through the second opening 14 from outside of the housing 11, and is elastically displaced in the vertical direction by the elastic deformation of the second curved portion 54*a* and the second straight arm portion 54*b*. The second contact portion 54*c* is also positioned above the base portion 52 when viewed from above.

In this way, a first contact member 56, including a first contact portion 56*c*, making contact with a contact pad 161 on the opposing device 101, and a pair of second contact members 54, each including a second contact portion 54*c*, making contact with the leading end of an electric wire 95, all make contact with the base portion 52. As a result, a single terminal 51 is connected electrically to two electric wires 95 and a contact pad 161 on the opposing device 101. Further, as a first contact member 56, including a vertically-displaceable first contact portion 56*c*, and second contact members 54, including vertically-displaceable second contact portions 54*c*, are arranged side-by-side in the transverse direction, the overall dimensions of the terminals 51 can be restrained in the vertical direction while increasing the dimensions from the base portion 52 to the first contact portion 56*c* and the second contact portions 54*c* and ensuring a sufficient amount of vertical displacement of the first contact portion 56*c* and the second contact portions 54*c*. Therefore, the vertical dimensions of the connector 1 can be restrained, and the connector 1 can be given a lower profile.

The operating portion 54*d* is elastically displaced with the second contact portions 54*c* in the vertical direction and, as mentioned earlier, positioned directly beneath a third opening 16 and pushed down by the leading end of a needle-shaped or rod-shaped member inserted into the third opening 16 from outside the housing 11. Because an electric wire 95 inserted through the second opening 14 is positioned directly above the second straight arm portion 54*b* when viewed from above and not above the operating portion 54*d* extending from the second straight arm portion 54*b* to the outside of the base portion 52 in the transverse direction, the operating portion 54*d* can be pushed down by the leading end of the needle-shaped or rod-shaped member inserted through the third opening 16 even when the second contact portion 54*c* comes into contact with the leading end of an electric wire 95 inserted through the second opening 14.

The fin member 57 is a flat member formed by making a cutout in a portion of the base portion 52. It extends upward orthogonally from the surface of the base portion 52, and also extends in the longitudinal direction of the base portion 52. Because the fin portion 57 extends in the longitudinal direction of the base portion 52, the rigidity of the flat base portion 52 is improved and the base portion 52 is more difficult to bend in the longitudinal direction. If the fin member 57 were to extend in the transverse direction of the base portion 52 in addition to the longitudinal direction of the base portion 52, the rigidity of the flat base portion 52 would be improved and the base portion 52 would be more difficult to bend in the longitudinal direction. In other words, the fin member 57 may also extend in a direction crossing the transverse direction of the base portion 52. In the example shown, the fin member 57 is formed near the other end of the base portion 52 in the longitudinal direction within the range of extension for the first contact member 56 when viewed from above. However, the position and size of the fin member 57 may be changed as long as the member does not interfere with the vertical displacement of the first contact portion 56*c* and the second contact portion 54*c*.

Figure 5A:
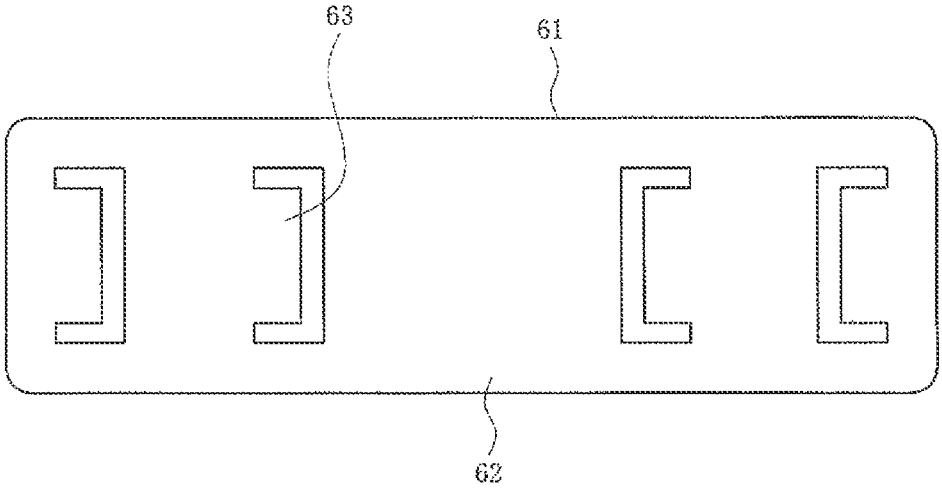
FIGS. 5(*a*)-(*b*) are a pair of views of a terminal supporting member in an embodiment of the Present Disclosure, in which FIG. 5(*a*) is a top view and FIG. 5(*b*) is a side view.
Figure 5B:
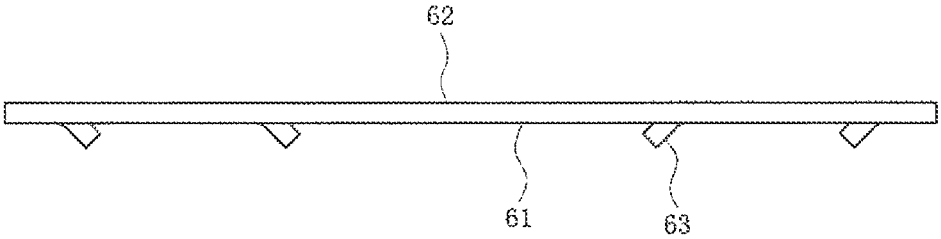

A terminal supporting member 61 is arranged inside each accommodating recessed portion 21 in the housing 11 above the second contact member 54, as shown in FIG. 5. The terminal supporting member 61 is a slender rectangular conductive metal plate having a rectangular flat base portion 62, and protruding pieces 63 cut out of a section of the base portion 62 and extending downward at an angle to be directed below the base portion 62 along the center line in the longitudinal direction. The base portion 62 is held by the housing 11, and the protruding pieces 63 make contact with the leading end of an electric wire 95 inserted through a second opening 14 from outside the housing 11. In the example shown, there are four protruding pieces 63. However, another number of protruding pieces can be used. In fact, the terminal supporting members 61 can be omitted if not necessary.

Figure 6:
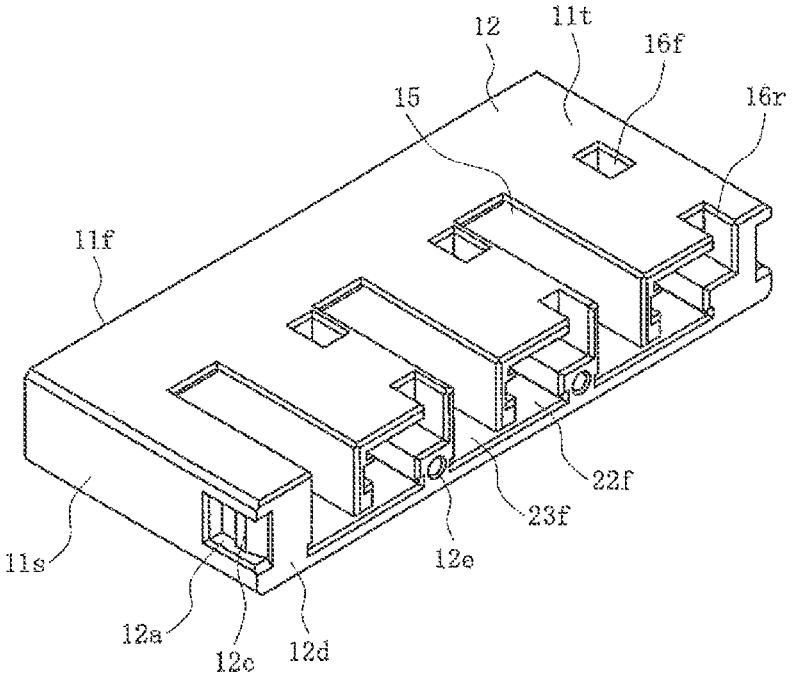
FIG. 6 is a perspective view of the front half portion of the housing in an embodiment of the Present Disclosure.
Figure 7:
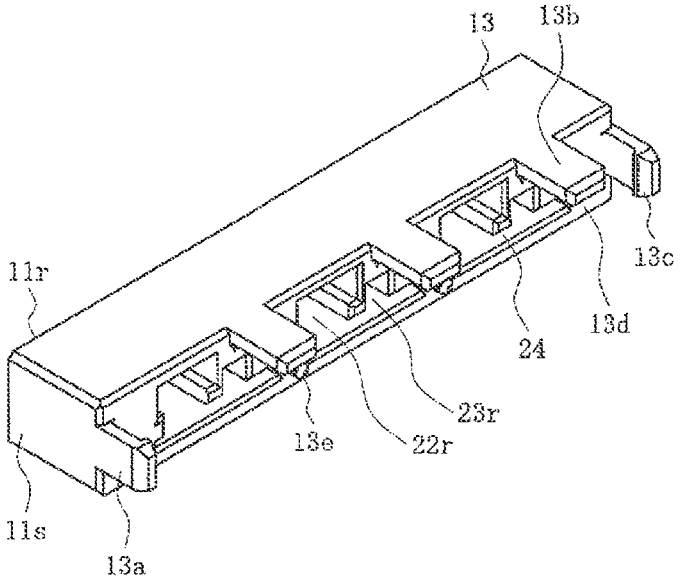
FIG. 7 is a perspective view of the rear half portion of the housing of FIG. 6.
Figure 8A:
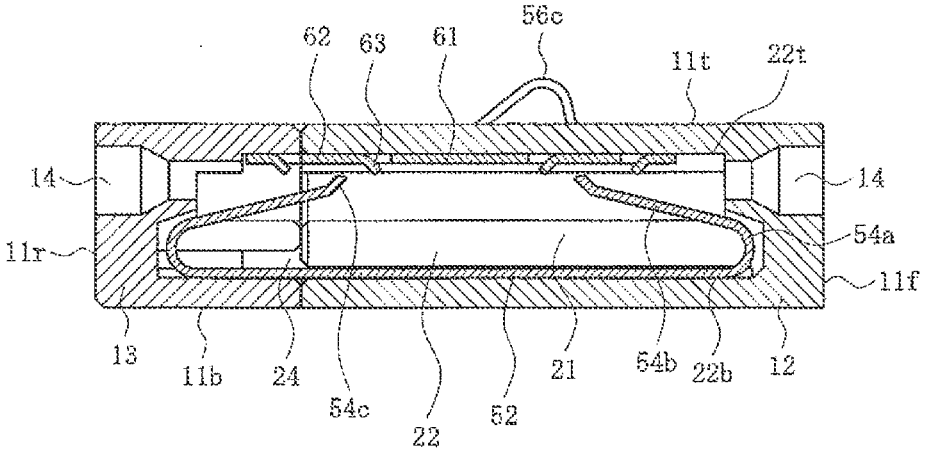
FIGS. 8(*a*)-(*b*) are a pair of cross-sectional views of the connector of FIG. 1, in which FIG. 8(*a*) is a cross-sectional view from Arrow A-A in FIG. 2(*b*) and FIG. 8(*b*) is a cross-sectional view from Arrow B-B in FIG. 2(*b*)
Figure 8B:
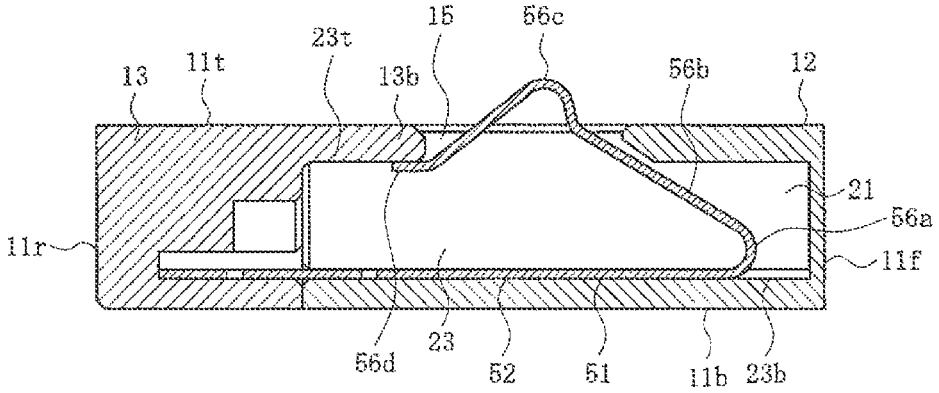

The housing 11 is illustrated with reference to FIGS. 6-8. FIG. 6 shows the front half portion 12 viewed from the side opposite that of the front surface 11*f* of the housing 11, and FIG. 7 shows the rear half portion 13 viewed from the side opposite that of the rear surface 11*r* of the housing 11. The front half portion 12 has a joined surface 12*d* opposite the front surface 11*f*, and the rear half portion 13 has a joined surface 13*d* facing the rear surface 11*r*. When the front half and rear half portions 12, 13 are joined, joined surfaces 12*d*, 13*d* face each other.

An engaging recessed portion 12*e* is formed in joined surface 12*d*, and an engaging protruding portion 13*e* is formed in joined surface 13*d*. When the front half portion 12 and the rear half portion 13 are joined, the engaging protruding portion 13*e* is inserted into and engages the engaging recessed portion 12*e*. The number and arrangement of engaging recessed portions 12*e* and engaging protruding portions 13*e* can be changed, and an engaging protrusion portion 13*e* can be formed in joined surface 12*d* and an engaging recessed portion 12*e* can be formed in joined surface 13*d*. The engaging recessed portions 12*e* and engaging protruding portions 13*e* can be omitted if not necessary.

An engaging protrusion 12*c* is formed in the leading end of the front engaging portion 12*a*, and an engaging protrusion 13*c* is formed in the leading end of the rear engaging portion 13*a*. When the front half portion 12 and the rear half portion 13 are joined, the engaging protrusions 12*c*, 13*c* engage each other. The front engaging portion 12*a* and the rear engaging portion 13*a* can be omitted if not necessary.

Because, as mentioned earlier, the first contact member 56 and the second contact member 54 of each terminal 51 are arranged side-by-side in the transverse direction of the base portion 52, each accommodating recessed portion 21 in the housing 11 for accommodating a terminal 51 has a first accommodating portion 23 for accommodating the first contact member 56, a second accommodating portion 22 for accommodating the second contact member 54, and a communicating portion 24 communicating with the first accommodating portion 23 and the second accommodating portion 22. In each accommodating recessed portion 21, the first accommodating portion 23 and the second accommodating portion 22 are arranged side-by-side in the transverse direction of the housing 11. In other words, they are arranged in parallel.

Because the first accommodating portion 23 accommodating a first contact member 56 with a vertically-displaceable first contact portion 56*c* and the second accommodating portion 22 accommodating a second contact member 54 with a vertically-displaceable second contact portion 54*c* are arranged side-by-side in the transverse direction, the overall dimensions of the housing 11 can be restrained in the vertical direction while increasing the dimensions of the first accommodating portion 23 and the second accommodating portion 22 in the vertical direction, and ensuring a sufficient amount of vertical displacement of the first accommodating portion 23 and the second accommodating portion 22. Therefore, the vertical dimensions of the connector 1 can be restrained, and the connector 1 can be given a lower profile. Further, because the first accommodating portion 23 and the second accommodating portion 22 communicate via the communicating portion 24, air can freely circulate inside the accommodating recessed portions 21, and localized heat buildup can be prevented even when the amount of electricity supplied to the terminals 51 is high and heat is generated.

The front half portion 12 includes a first front accommodating portion 23*f* and a second front accommodating portion 22*f* extending from the joined surface 12*d* towards the front surface 11*f*, and the rear half portion 13 includes a first rear accommodating portion 23*r* and a second accommodating portion 22*r* extending from the joined surface 13*d* towards the rear surface 11*r*. A communicating portion 24 is formed near the joined surface 13*d* in the rear half portion 13 for communication between the first rear accommodating portion 23*r* and the second rear accommodating portion 22*r*. When the front half portion 12 and the rear half portion 13 are joined, the first front accommodating portion 23*f* and the first rear accommodating portion 23*r* form the first accommodating portion 23, and the second front accommodating portion 22*f* and the second rear accommodating portion 22*r* form the second accommodating portion 22.

A section of the first front accommodating portion 23*f* (extending from the joined portion 12*d* to the front surface 11*f* but stopping in the middle) is opened in the top surface 11*t* to form a first opening 15. The rear half portion 13 includes stopping members 13*b* protruding forward from the joined surface 13*d*. Each stopping member 13*b* is formed above the first rear accommodating portion 23*r*. When the front half portion 12 and the rear half portion 13 are joined, they are inserted upward into the corresponding first front accommodating portion 23*f* to seal a portion of the first opening 15. As a result, the dimensions of the first opening 15 related to the longitudinal direction of the housing 11 are shorter than those shown in FIG. 6.

Each second front accommodating portions 22*f* opens into the top surface 11*t* in two locations, forming a third front opening 16*f* and a third rear opening 16*r*. The side of the third rear opening 16*r* near the rear surface 11*r* is defined by the joined surface 13*d* of the rear half portion 13 when the front half portion 12 and the rear half portion 13 are joined. Each second opening 14 is formed in a location corresponding to a second front accommodating portion 22*f* in the front surface 11*f* to pass through from the front surface 11*f* to the second front accommodating portion 22*f*, and each second opening 14 is formed in a location corresponding to a second rear accommodating portion 22*r* in the rear surface 11*r* to pass through from the rear surface 11*r* to the second rear accommodating portion 22*r*.

When the connector 1 is manufactured, the base portion 62 of the terminal supporting member 61 is pushed into the second front accommodating portion 22*f* from the joined surface 12*d* side of the front half portion 12 as shown in FIG. 6, and then the base portion 52 of the terminals 51 is pushed into the first front accommodating portion 23*f* and the second front accommodating portion 22*f* so that the first contact member 56 and the second contact member 54 are pushed in. Next, the rear half portion 13 is oriented so that the joined surface 13*d* is facing the joined surface 12*d* of the front half portion 12, and moved towards the front half portion 12 until it is joined with the front half portion 12. At this time, a section of the terminal supporting member 61 and a section of the terminals 51 protruding from the joined surface 12*d*, while still remaining accommodated inside the first front accommodating portion 23*f*, and the second front accommodating portion 22*f*, are accommodated inside the first rear accommodating portion 23*r*, second rear accommodating portion 22*r* and the communicating portion 24 of the rear half portion 13. The portions of the base portion 62 of the terminal supporting member 61 and the base portion 52 of the terminals 51 protruding from the joined surface 12*d* are pushed into the first rear accommodating portion 23*r* and the second rear accommodating portion 22*r*.

The engaging protruding portion 13*e* moves into and engages the engaging recessed portion 12*e*, and the engaging protrusion 12*c* of the front engaging portion 12*a* engages the engaging protrusion 13*c* of the rear engaging portion 13*a*. If necessary, an adhesive may be applied to bond the joined surfaces 12*d*, 13*d* together, or ultrasonic vibration may be applied to fuse the joined surfaces 12*d*, 13*d* together. In this way, as shown in FIG. 8, the terminals 51 and terminal supporting member 61 are housed inside the accommodating recessed portions 21 of the housing 1. More specifically, the base portion 62 of the terminal supporting member 61 is held by the housing 11 while arranged along the top surface 22*t* of the second accommodating portion 22, and the protruding pieces 63 protrude at an angle towards the bottom surface 22*b* of the second accommodating portion 22.

The terminals 51 are also accommodated inside the accommodating recessed portion 21 so that the longitudinal direction and transverse direction of the base portions 52 are aligned with the longitudinal direction and transverse direction of the housing 11. Here, the base portions 52 are held by the housing 11 while arranged along the bottom surface 23*b* of the first accommodating portion 23 and the bottom surface 22*b* of the second accommodating portion 22, and the fin member 57 is positioned inside the first accommodating portion 23. The fin member 57 is positioned to correspond to the joined portion of the front half portion 12 and the rear half portion 13 relative to the longitudinal direction of the housing 11.

The first contact member 56 is positioned inside the first accommodating portion 23, and the first contact portion 56*c* protrudes above the top surface 11*t* via a first opening 15. Before the connector 1 is connected to the opposing device 101, the amount by which the first contact portion 56*c* protrudes from the top surface 11*t* should not protrude excessively from the standpoint of handling. Therefore, the portion of the first opening 15 near the rear surface 11*r* is stopped by a stopping member 13*b*, and the stopped portion 56*d* of the first contact member 56 comes into contact with the bottom surface of the stopping member 13*b*; that is, the top surface 23*t* of the first accommodating portion 23 to restrict the amount by which the first contact portion 56*c* protrudes upward from the top surface 11*t*. Because the first contact member 56 functions as an elastic spring member, the spring action presses the stopped portion 56*d* against the top surface 23*t* from below.

The second contact member 54 is positioned inside the second accommodating portion 22, and the second contact portion 54*c* comes into contact with the top surface 22*t* of the second accommodating portion 22 or the bottom surface of the terminal supporting member 61. Because the second contact member 54 functions as an elastic spring member, the spring action presses the second contact portion 54*c* against the top surface 22*t* or the terminal supporting member 61 from below. The terminal supporting member 61 is positioned directly above the second straight arm portion 54*b* relative to the transverse direction of the housing 11, but is not positioned above the operating portion 54*d* protruding outward from the second straight arm portion 54*b* in the transverse direction of the base portion 52 and is not positioned directly below the third opening 16. Therefore, when the leading end of a needle-shaped or rod-shaped member (not shown) is inserted into the third opening 16 from outside the housing 11, the operating portion 54*d* can be displaced downward along with the second contact portion 54*c*.

The end portion of the second opening 14 on the second accommodating portion 22 side is positioned directly above the second straight arm portion 54*b* relative to the transverse direction of the housing 11, and between the second straight arm portion 54*b* and the terminal supporting member 61 relative to the vertical direction of the housing 11. Therefore, when the leading end of an electric wire 95 is inserted into the second opening 14 from outside the housing 11 and reaches into the second accommodating portion 22, it passes between the second contact portion 54*c* at the front end of the second straight arm portion 54*b* and the terminal supporting member 61, and displaces the second contact portion 54*c* downward.

In the present embodiment, the housing 11 is obtained by joining together the front half portion 12 and the rear half portion 13. The dimensions of the front half portion 12 and the dimensions of the rear half portion 13 are not the same but different relative to the longitudinal direction of the housing 11. In other words, when the half portions 12, 13 are joined together, the joined portion of the front half portion 12 and the rear half portion 13 is positioned to the outside of the center line of the housing 11 in the longitudinal direction.

In the example shown, the dimensions of the housing 11 relative to the longitudinal direction are greater in the front half portion 12 than in the rear half portion 13, and have an approximate 7:3 ratio. In other words, the distance from joined surface 12*d* and joined surface 13*d* to the front surface 11*f* relative to the distance to the rear surface 11*r* is approximately 7:3. Also, the distance from front engaging portion 12*a* and rear engaging portion 13*a* to the front surface 11*f* relative to the distance to the rear surface 11*r* is 6:4.

Because the joined portion of the half portions 12, 13 is positioned to the outside of the center line of the housing 11 in the longitudinal direction, the front half portion 12 and the rear half portion 13 are difficult to separate even when force is applied which bends the housing 11 longitudinally, and the overall strength of the housing 11 is increased. When force is applied which bends the housing 11 longitudinally, the bending moment is believed to be greatest along the center line in the longitudinal direction. In material physics, this is clear from an analysis of the bending moment in which an equal load is applied to both ends of a support beam. In the present embodiment, the joined portion of the front half portion 12 and the rear half portion 13 is positioned outside of the location of the greatest bending moment, and the front half portion 12 and the rear half portion 13 are difficult to separate.

The fin member 57 formed in the base portion 52 of a terminal 51 pushed into an accommodating recessed portion 21 is in a position corresponding to the joined portion of the front half portion 12 and the rear half portion 13. In other words, the fin member 57, which makes it difficult to bend the base portion 52 in the longitudinal direction, is in a position corresponding to the joined portion of the front half portion 12 and the rear half portion 13 relative to the longitudinal direction of the housing 11. Therefore, even if a force were applied that bends the housing 11 in the longitudinal direction and a bending moment were to occur at the joined portion of the front half portion 12 and the rear half portion 13, the highly rigid fin member 57 would receive the bending moment and the front half portion 12 and the rear half portion 13 would be difficult to separate.

The second contact member 54 is pushed in along the top surface 22*t* of the second accommodating portion 22, and the base portion 52 of the terminals 51 is pushed in along the bottom surface 23*b* of the first accommodating portion 23 and the bottom surface 22*b* of the second accommodating portion 22. In other words, the second contact member 54 is pushed into the second front accommodating portion 22*f* and the second rear accommodating portion 22*r* near the top surface 11*t* on the higher end of the housing 11, and the base portions 52 of the terminals 51 are pushed into the first front accommodating portion 23*f*, the second front accommodating portion 22*f*, the first rear accommodating portion 23*r*, and the second rear accommodating portion 22*r* near the bottom surface 11*b* on the lower end of the housing 11 so that the front half portion 12 and the rear half portion 13 are joined. Therefore, when a force is applied that bends the housing 11 in the longitudinal direction, the tensile stress is received by the second contact member 54 or the base portions 52 of the terminals 51 pushed in to join the front half portion 12 and the rear half portion 13 at the point of maximum stress, and the front half portion 12 and the rear half portion 13 are difficult to separate.

Figure 9:
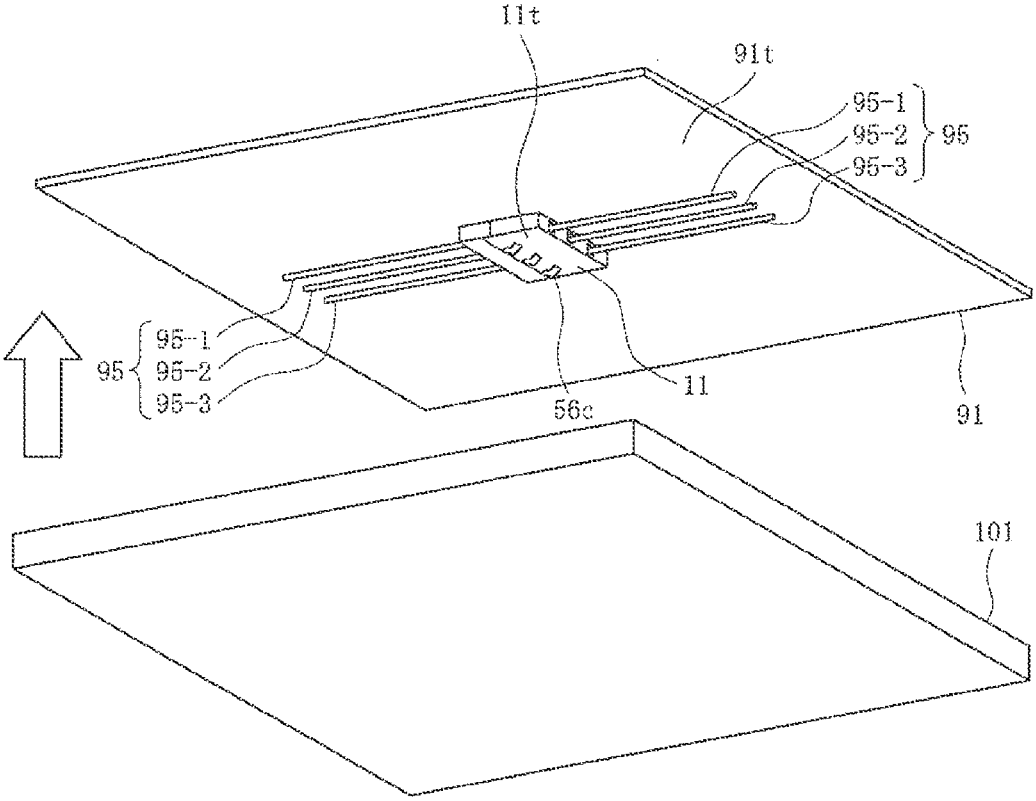
FIG. 9 is a diagram showing the operation performed to connect an opposing device to the connector in an embodiment of the Present Disclosure.
Figure 10A:
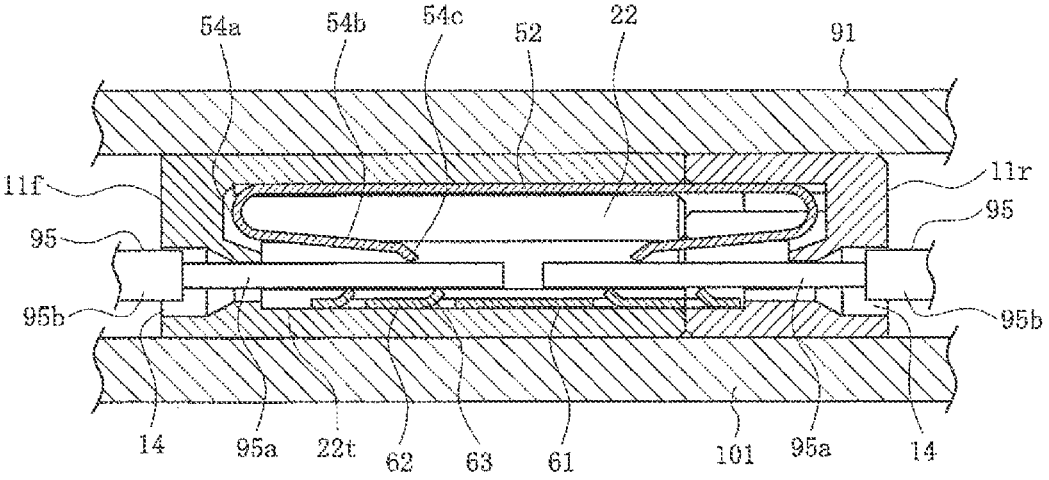
FIGS. 10(*a*)-(*b*) are a pair of cross-sectional views showing the opposing device connected to the connector in FIG. 9, in which FIG. 10(*a*) is a cross-sectional view of the portion corresponding to FIG. 8(*a*) and FIG. 10(*b*) is a cross-sectional view of the portion corresponding to FIG. 8(*b*)
Figure 10B:
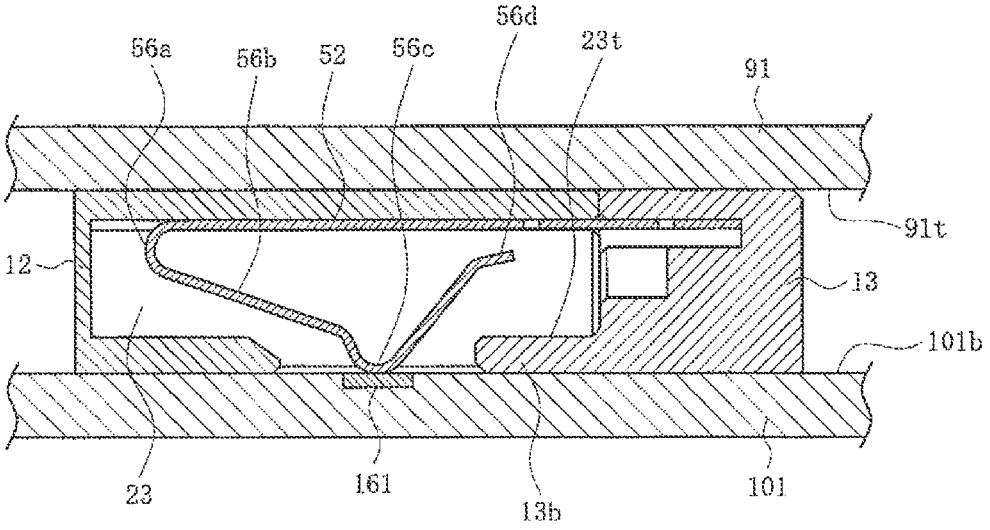
Figure 11A:
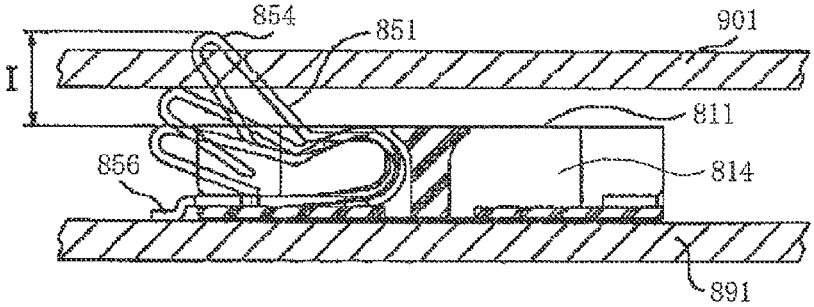
FIGS. 11(*a*)-(*b*) are a pair of diagrams showing the connection of a conventional connector to a board, in which FIG. 11(*a*) shows the terminals in various positions of elastic deformation and FIG. 11(*b*) shows the terminals fully elastically deformed.
Figure 11B:
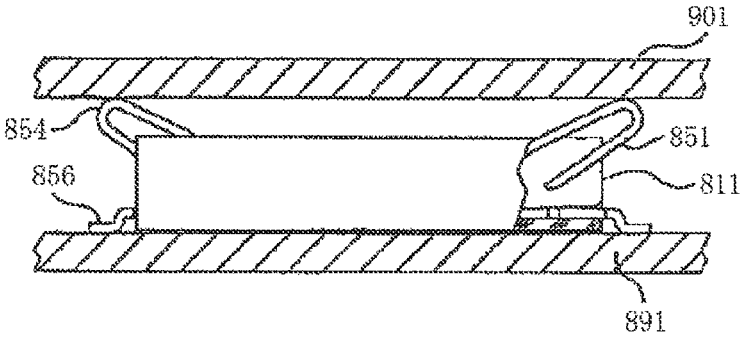
FIG. 11B Prior art

FIGS. 9-10 illustrate the operation performed to connect an opposing device 101 to the connector 1. The connector 1 in the present embodiment, as shown in FIG. 9, is mounted on the top surface 91*t* of a base 91. The base 91 may be made of any type of material, but here it is used as a plate analogous to the ceiling of a building. The connector is mounted using a mounting means such as an adhesive, bolts or a fitting while the bottom surface 11*b* of the housing 11 is in contact with the top surface 91*t* of the base 91. Here, the vertical orientation of the connector 1 is the opposite of that shown in FIG. 1 with the bottom surface 11*b* of the housing 11 facing upwards, the ceiling surface 11*t* facing downwards, and the first contact portion 56*c* protruding downwards.

The opposing device 101 can be any type of connector. In the following explanation, it is a flat LED lighting device. The opposing device 101 is moved towards the base 91 in the direction of the arrow shown in FIG. 9, and is mounted on the housing 11 or base 91 using a mounting means such as an adhesive, bolts or a fitting. The opposing device 101 is preferably detachable from the housing 11 or base 91. Contact pads 161 are exposed on the connecting surface 101*b* of the opposing device 101 opposite the top surface 11*t* of the housing 11.

A plurality of opposing devices 101 are arranged side by side. Therefore, power from a power source (not shown) has to be supplied uniformly to all of the opposing devices 101, and the opposing devices 101 have to be connected to the power source using a parallel circuit. Therefore, three electric wires 95 are connected to the connector 1 from the left and right. In this example, the first electric wire 95-1 is a direct current power line, the second electric wire 95-2 is a ground line, and the third electric wire 95-3 is a control line used to modulate the width of the pulses controlling the opposing device 101. When there is a single opposing device 101 and end point in a series of opposing devices 101, the three electrical wires 95 are connected to the connector 1 on either the left or the right.

FIG. 10(*a*) shows the electrical wires 95 connected to the connector 1 from the left and right. Each electric wire 95 has a core wire 95*a* with a round cross-sectional profile, and a sheath 95*b* made from an insulating material such as a synthetic resin formed around the core wire 95*a*. The sheath 95*b* is removed from the leading end of each electric wire 95 to a certain length in order to expose the core wire 95*a*. The core wire 95*a*, exposed on the leading end of an electric wire 95, is inserted into a second opening 14 from the outside of the housing 11, and reaches a second accommodating portion 22, where it is inserted between the second contact portion 54*c* on the leading end of the second straight arm portion 54*b* and the terminal supporting member 61. The second contact portion 54*c* is elastically displaced towards the base portion 52 (upwards in FIG. 10(*a*)).

The second contact member 54, functioning as a spring member, provides spring action from the displaced second contact portion 54*c*. The spring action causes the second contact portion 54*c* to push the core wire 95*a* against the terminal supporting member 61. In this way, the core wire 95*a* is interposed between the second contact portion 54*c* and the protruding piece 63 of the terminal supporting member 61, and a reliable electrical connection is established with the second contact portion 54*c*.

The second contact portion 54*c* and the protruding piece 63 extend towards the center in the longitudinal direction of the housing 11. Therefore, when the core wire 95*a* is inserted through a second opening 14 from outside of the housing 11, it is easily inserted between the second contact portion 54*c* and the protruding piece 63, and is difficult to pull out from between the second contact portion 54*c* and the protruding piece 63 when pulled out of the housing 11. When the electric wire 95 is to be disconnected, the leading end of a needle-shaped or rod-shaped member is inserted into the third opening 16 from outside of the housing 11 to displace the operating portion 54*d* and the second contact portion 54*c* in the direction of the base portion 52 and remove the electric wire 95 from the second opening 14.

When an opposing device 101 is mounted on the housing 11 or the base 91, as shown in FIG. 10(*b*), the first contact portion 56*c* on the first contact member 56 makes contact with an exposed contact pad 161 on the connecting surface 101*b* of the opposing device 101. Here, the contact pad 161 of the opposing device 101 elastically displaces the first contact portion 56*c* in the direction of the base portion 52 (upwards in FIG. 10(*b*)).

The first contact member 56, functioning as a spring member, provides spring action from the displaced first contact portion 56*c*, and the spring action presses the first contact portion 56*c* against the contact pad 161. This establishes a reliable electrical connection between the first contact portion 56*c* and the contact pad 161. Because, as mentioned earlier, the first contact portion 56*c* is elastically displaceable until it protrudes from the top surface 11*t*, reliable contact is maintained between the first contact portion 56*c* and the contact pad 161 even when there are gaps between the connecting surface 101*b* of the opposing device 101 and the top surface 1*t* of the housing 11.

The connector 1 in the present embodiment has a housing 11 made from an insulating material and terminals 51 made from a conductive material installed in the housing 11. The terminals have a flat base portion 52 held by the housing 11, an elastically-deformable first contact member 56 connected on one end to the base portion 52 in the longitudinal direction, and a pair of elastically-deformable second contact members 54 connected to the ends of the base portion 52 in the longitudinal direction. The first contact member 56 includes an elastically-displaceable first contact portion 56*c* in the vertical direction, and each second contact member 54 includes an elastically-displaceable second contact portion 54*c* in the vertical direction. When viewed from above, the pair of second contact members 54 are arranged linearly in the longitudinal direction of the base portion 52, the first contact member 56 and the second contact member 54 are arranged in the transverse direction of the base portion 52, and the first contact portion 56*c* and the second contact portion 54*c* are positioned on the base portion 52.

Because the first contact member 56 having a first contact portion 56*c* making contact with a contact pad 161 on the opposing device 101 and the pair of second contact members 54 each having a second contact portion 54*c* making contact with the leading end of an electric wire 95 are both connected to the base portion 52, two electric wires 95 and a contact pad 161 on an opposing device 101 can be connected electrically using a single terminal 51. Because the first contact member 56 with a vertically-displaceable first contact portion 56*c* and a second contact member 54 with a vertically-displaceable second contact portion 54*c* are arranged side by side in the transverse direction, the overall vertical dimensions of the terminal 51 can be restrained in the vertical direction while increasing the dimensions from the base portion 52 to the first contact portion 56*c* and the second contact portions 54*c* and ensuring a sufficient amount of vertical displacement of the first contact portion 56*c* and the second contact portions 54*c*. Therefore, the vertical dimensions of the connector 1 can be restrained, and the connector 1 can be given a lower profile. In other words, the contact pad 161 comes into contact with the first contact portion 56*c*, the pair of electric wires 95 are connected electrically, and a reliable connector 1 can be provided that is easy to manufacture, and has a simple configuration and a low profile.

The first contact member 56 also includes a first curved portion 56*a* connected to the base portion 52 and a first straight arm portion 56*b* connected at the base end to the first curved portion 56*a*. The first contact portion 56*c* is connected at the leading end to the first straight arm portion 56*b*. Each second contact member 54 includes a second curved portion 54*a* connected to the base portion 52, and a second straight arm portion 54*b* connected on the base end to the second curved portion 54*a*. The second contact portion 54*c* is connected to the leading end of the second straight arm portion 54*b*. In this way, the spring length of the first contact member 56 and the second contact member 54 can be increased, the first contact portion 56*c* and the second contact portion 54*c* can be elastically displaced within a wider vertical range, and reliable contact can be maintained between the contact pad 161 and the electrical wires 95.

The base portion 52 includes an integrally-formed fin member 57. The fin member 57 is a flat member extending in a direction orthogonal to the surface of the base portion 52 and in a direction crossing the transverse direction of the base portion 52. This increases the rigidity of the flat base portion 52, and makes the base portion 52 more difficult to bend in the longitudinal direction.

The housing 11 includes a plurality of accommodating recessed portions 21 for accommodating a terminal 51 arranged side by side in the transverse direction of the housing 11. Each accommodating recessed portion 21 includes a first accommodating portion 23 for accommodating a first contact member 56, a second accommodating portion 22 for accommodating second contact members 54, and a communicating portion 24 allowing the first accommodating portion 23 and the second accommodating portion 22 to communicate. The first accommodating portion 23 and the second accommodating portion 22 are arranged side by side in the transverse direction of the housing 11. Because the first accommodating portion 23 and the second accommodating portion 22 are arranged side by side in the transverse direction, the overall dimensions of the housing 11 in the vertical direction can be restrained and the connector 1 given a lower profile while also increasing the vertical dimensions of the first accommodating portion 23 and the second accommodating portion 22, and ensuring a sufficient amount of vertical displacement of the first contact portion 56*c* and the second contact portion 54*c*. Because the vertical dimensions of the first accommodating portion 23 and the second accommodating portion 22 can be increased and the volume of the first accommodating portion 23 and the second accommodating portion 22 can be increased, localized overheating can be prevented inside the first accommodating portion 23 and the second accommodating portion 22 when a large amount of power is supplied to a terminal 51 and heat is generated. Finally, because the first accommodating portion 23 and the second accommodating portion 22 communicate via the communicating portion 24, air can freely circulate inside the accommodating recessed portions 21 and localized heat buildup can be prevented even when the amount of electricity supplied to the terminals 51 is high and heat is generated.

The housing 11 includes a first opening 15 passing through the housing from the top surface 11*t* to the first accommodating portion 23, and a second opening 14 passing through the housing from the front surface 11*f* and rear surface 11*r* to the second accommodating portion 22. The first contact portion 56*c* is exposed by the first opening 15 and brought into contact with a contact pad 161 positioned above the top surface 11*t*, and the second contact 54*c* is brought into contact with an electric wire 95 inserted into the second opening 14. In this way, reliable contact can be maintained between the first contact portion 56*c* and the contact pad 161, and reliable contact can be maintained between the second contact portion 54*c* and the electric wire 95.

A terminal supporting member 61 is installed in the housing 11, and this terminal supporting member 61 includes a flat base portion 62 held in the housing 11 and a protruding piece 63 formed in the base portion 62. The protruding piece 63 is arranged inside the second accommodating portion 22 so the protruding piece 63 opposes the second contact portion 54*c*. Because the electric wire 95 is interposed between the second contact portion 54*c* and the protruding piece 63, it is securely connected to the second contact portion 54*c*.

Also, the housing 11 is formed so that front half portion 12 near the front surface 11*f* and the rear half portion 13 near the rear surface 11*r* are joined, and the joined portion of the front half portion 12 and the rear half portion 13 are positioned away from the center line of the housing 11 in the longitudinal direction. In this way, the front half portion 12 and the rear half portion 13 are difficult to separate even when force is applied which causes the housing 11 to bend longitudinally, and the overall strength of the housing 11 is improved.

While a preferred embodiment of the Present Disclosure is shown and described, it is envisioned that those skilled in the art may devise various modifications without departing from the spirit and scope of the foregoing Description and the appended Claims.

What is claimed is:

1. A connector, the connector comprising:

a housing, the housing being made from an insulating material; and a terminal, the terminal being made from a conductive material and installed in the housing, the terminal including a flat base portion held by the housing, an elastically deformable first contact member connected on one end to the base portion in the longitudinal direction, and a pair of elastically deformable second contact members connected to the one end and to the other end of the base portion in the longitudinal direction, the first contact member including an elastically displaceable first contact portion in the vertical direction, each second contact member including an elastically displaceable second contact portion in the vertical direction, the pair of second contact members are arranged linearly in the longitudinal direction of the base portion, the first contact member and the second contact member are arranged in the transverse direction of the base portion, and the first contact portion and the second contact portion are positioned on the base portion.

2. The connector of claim 1, wherein the first contact member further includes a curved portion connected to the base portion.

3. The connector of claim 2, wherein the first contact member further includes a straight arm portion connected at a base end to the curved portion.

4. The connector of claim 3, wherein the first contact portion is connected at a leading end to the straight arm portion.

5. The connector of claim 1, wherein each second contact member further includes a curved portion connected to the base portion.

6. The connector of claim 5, wherein each second contact member further includes a straight arm portion connected on a base end to the curved portion.

7. The connector of claim 6, wherein the second contact portions are connected to a leading end of the straight arm portion.

8. The connector of claim 1, wherein the base portion includes an integrally formed fin member.

9. The connector of claim 8, wherein the fin member is a flat member extending in a direction orthogonal to a surface of the base portion in a direction crossing the transverse direction of the base portion.

10. The connector of claim 1, wherein the housing includes a plurality of accommodating recessed portions for accommodating the terminal arranged side by side in the transverse direction of the housing.

11. The connector of claim 10, wherein each accommodating recessed portion includes a first accommodating portion for accommodating the first contact member, a second accommodating portion for accommodating the second contact members, and a communicating portion allowing the first accommodating portion and the second accommodating portion to communicate.

12. The connector of claim 11, wherein the first accommodating portion and the second accommodating portion are arranged side by side in the transverse direction of the housing.

13. The connector of claim 12, wherein the housing further includes an opening passing through the housing from a top surface of the housing to the first accommodating portion.

14. The connector of claim 12, wherein the housing further includes an opening passing through the housing from a front surface of the housing and a rear surface of the housing to the second accommodating portion.

15. The connector of claim 13, wherein the first contact portion is exposed by the opening and brought into contact with an opposing first contact member positioned above the top surface.

16. The connector of claim 14, wherein the second contact portion is brought into contact with an opposing second contact member inserted into the opening.

17. The connector of claim 11, further comprising a terminal supporting member installed in the housing.

18. The connector of claim 17, wherein the terminal supporting member includes a flat base portion held in the housing and a protruding piece formed in the base portion.

19. The connector of claim 18, wherein the protruding piece is arranged inside the second accommodating portion so the protruding piece opposes the second contact portion.

20. The connector of claim 1, wherein the housing is formed so that a front half portion near the front surface of the housing and a rear half portion near the rear surface of the housing are joined, and the joined portion of the front half portion and the rear half portion are positioned away from a center line of the housing in the longitudinal direction.

21. A connector, the connector comprising:

a housing, the housing being made from an insulating material; and a terminal, the terminal being made from a conductive material and installed in the housing, the terminal including a base portion held by the housing, a first contact member connected on one end to the base portion in the longitudinal direction, and a pair of second contact members connected to the one end and to the other end of the base portion in the longitudinal direction, the first contact member including a first contact portion in the vertical direction, each second contact member including a second contact portion in the vertical direction, the pair of second contact members are arranged linearly in the longitudinal direction of the base portion, the first contact member and the second contact member are arranged in the transverse direction of the base portion, and the first contact portion and the second contact portion are positioned on the base portion.

* * * * *